United States Patent [19]

Palmer

[11] Patent Number: 5,039,135

[45] Date of Patent: Aug. 13, 1991

[54] DRAIN TRAP WITH ICE PLUG PREVENTION

[76] Inventor: Richard R. Palmer, 1961 Gillian Rd., Placentia, Calif. 92670

[21] Appl. No.: 625,075

[22] Filed: Dec. 10, 1990

[51] Int. Cl.[5] ..... E03C 1/24; E03F 7/00

[52] U.S. Cl. ..... 285/179; 4/206; 138/32

[58] Field of Search ..... 4/191, 206, 640, 650; 138/32; 285/179

[56] References Cited

U.S. PATENT DOCUMENTS

| | | | |
|---|---|---|---|
| 299,352 | 5/1884 | Coburn | 138/32 X |
| 4,562,861 | 1/1986 | Payton | 138/32 |

FOREIGN PATENT DOCUMENTS

| | | | |
|---|---|---|---|
| 3536993 | 4/1987 | Fed. Rep. of Germany | 4/206 |
| 22744 | 2/1962 | German Democratic Rep. | 4/206 |
| 1254126 | 8/1986 | U.S.S.R. | 4/206 |
| 2142056 | 1/1985 | United Kingdom | 4/206 |

*Primary Examiner*—Daniel M. Yasich

*Attorney, Agent, or Firm*—Georges A. Maxwell

[57] ABSTRACT

An improved elongate drain trap made of a material having a low index of heat conductivity and having inlet and outlet end portions and a substantially U-shaped central basin portion below and extending between the end portions and in which water is contained and sometime freezes to establish an ice plug; the improvement comprises an elongate insert made of material having a high index of heat conductivity and having an upper end portion in the inlet portion of the trap and a lower end portion extending through the central basin portion of the trap. The insert functions to absorb heat from hot water deposited in the inlet portion of the trap and to conduct that heat through the basin portion of the trap where it melts a sufficient portion of an ice plug formed therein to establish a flow passage for water through the plug.

9 Claims, 2 Drawing Sheets

DRAIN TRAP WITH ICE PLUG PREVENTION

PRIOR ART

Applicant knows of no prior art drain trap that is established of a heat-insulating plastic material in which a metal heat-conducting insert is positioned so that a small volume of heated water introduced into the upstream end of the trap heats the insert and wherein the heated insert works to melt a portion of an ice plug formed in the drain to establish a flow passage for water through said plug therein.

BACKGROUND OF THE INVENTION

In the art of plumbing water systems in residential, commercial and industrial buildings, it is common practice to provide water basins or sinks to receive and hold volumes of water in which, for example, cooking utensils, clothes and the like can be washed. Typically, such sinks are provided with drain openings at their bottoms. The drain openings are suitably connected with waste pipes that extend to suitable waste facilities such as sewer systems and septic tanks. As a general rule, dangerous and unpleasant gases are generated in sewer systems, septic tanks and the like. To prevent such gases from flowing back through the drain pipes and thence into the sinks, those means provided to connect the sinks with the drain pipes include gas or drain traps. Ordinary drain traps are tubular metal structures with U-shaped portions having lower tubular bases and upwardly projecting tubular legs. The U-shaped portions of the drain traps define trap basins in which limited volumes of water are contained to establish plugs through which gases tending to flow back through and from the drain pipes cannot flow.

A major shortcoming of metal drain traps of the general character referred to above resides in the fact that the drain traps are frequently subjected to subfreezing (below 32° F.) temperatures which cause the water in their trap basin portions to freeze and establish ice plugs by or through which liquids or water in the sinks, cannot flow and drain and that render the sinks unservicable.

In addition to the above, the formation of ice plugs in drain traps frequently ruptures the drain traps or otherwise adversely affects the structural integrity thereof.

If an ice plug in a drain trap is not melted or otherwise reduced and/or removed from within the drain trap, the plug will remain in fixed place therein until the ambient temperature about the drain trap rises well above 32° F. and remains at such an elevated temperature for a sufficient time to heat the drain trap and cause the plug therein to melt.

When ice plugs form in the trap basins of drain traps, it has long been common practice to accelerate the melting of those plugs by heating the drain traps, at and about the exteriors thereof. When heating drain traps to melt ice plug therein, it is not uncommon for persons to utilize blow torches, electric hair dryers, electric heating pads, electric radiant heaters and various other heat-generating devices as heat sources. Such practices are obviously highly inconvenient, inefficient and often unsafe.

Another and notable number of persons, in anticipation of the likelihood that ice will form in and plug the drain traps related to their sinks seek to prevent the formation of ice in the traps by introducing or pouring a volume of polyethylene glycol and other anti-freeze materials down the drains of their sinks and thence into the drain traps. The obvious shortcomings of such practices reside in the fact that the anti-freeze materials are quite costly and troublesome to use. Further, most anti-freeze materials are pollutants that should not to be disposed of in sewer systems and are such that if introduced into septic tanks they adversely affect or kill those microbes in such tanks are relied upon to reduce waste deposited therein.

In accordance with the foregoing, there is a recognized want and need for an improved drain trap structure which is such that when it is plugged by the formation of an ice plug therein, the ice plug can be easily, quickly and efficiently melted to establish a flow of water through the trap.

OBJECTIVES AND FEATURES OF THE INVENTION

An object of this invention is to provide an improved elongate drain trap having upstream inlet and downstream outlet end portions and a central basin portion in which water is trapped and in which trapped water sometimes freezes to establish an ice plug; the improvement comprises an elongate heat-conducting insert with an upper end portion positioned in the upstream end portion of the trap to absorb heat from heated water deposited in the trap and a lower end portion extending through the basin portion of the trap to conduct heat from its upper portion into and through an ice plug that has formed in the basin portion and to melt a sufficient portion of the ice plug to initiate a flow of water through the plug.

Another object of the invention is to provide a drain trap of the character referred to above wherein the basin portion is formed to permit the substantial free expansion of water, as it freezes, without exerting adverse forces onto the structure that defines the basin portion of the trap.

Yet another object and feature of the invention is to provide a drain trap of the general character referred to that is made of a resin (plastic) material having a low index of thermal conductivity and wherein said insert is made of a metal having a high index of heat conductivity.

Yet another object and feature of the invention is to provide an improved drain trap of the general character referred to wherein the above-noted heat-conducting insert is thermally insulated from the ambient atmosphere and the environment in which the trap is situated by the thermal insulating plastic material of which the trap is made and is formed so that its upper portion is of substantial mass and large surface area and its lower portion is of minor mass and surface area whereby the upper portion absorbs and conducts to the lower portion sufficient heat to melt a sufficient portion of an ice plug in the basin portion to establish a flow of water by it and through the trap.

It is an object and feature of the invention to provide a drain trap of the general character referred to above wherein the low index of heat conductivity or heat-insulating properties of the trap and the high index of heat conductivity or heat-conducting properties of the insert are advantageously utilized and combined to effect rapid melting of a portion of an ice plug in the basin portion of the trap to establish a flow passage through the plug, with that volume of hot water that can be deposited in and contained by the upstream end of the trap and a related drain fitting and to thereby initiate a flow of that hot water through the plug to further melt the plug and increase the flow of water therethrough.

The above and other objects and features of the invention will be fully understood and will be made apparent in the following detailed description of the invention throughout which description reference is made to the accompanying drawings.

DETAILED DESCRIPTION OF THE INVENTION

Figure 1:
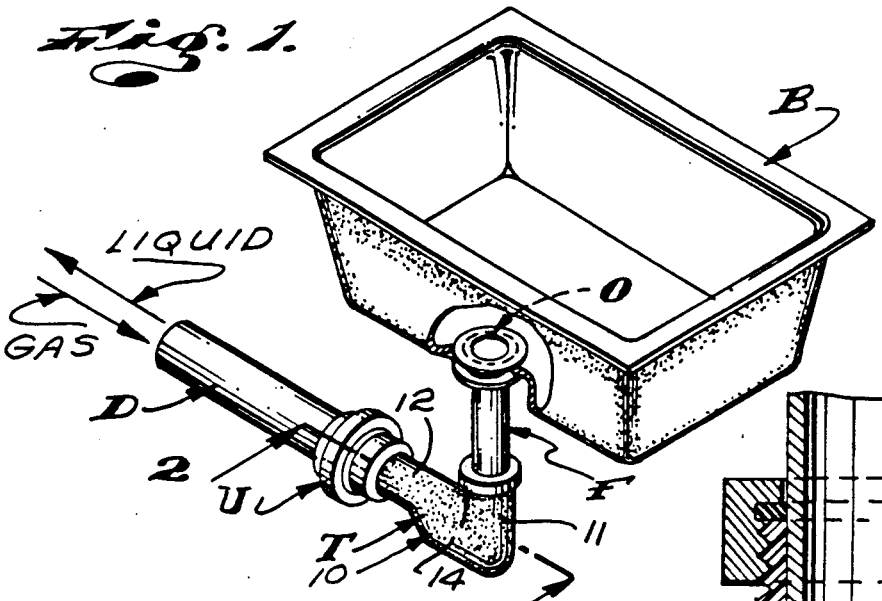
FIG. 1 is an isometric view of my new drain trap showing it connected with a between a related basin and drain pipe.

Referring to FIG. 1 of the drawings, I have shown my new drain trap T connected with and between a tubular drain fitting F that is engaged in and depends from a drain opening O in a wash basin B and the upstream or inlet end of a drain pipe D.

In the case illustrated, the drain fitting F includes a straight vertically extending metal drain tube part the upper end of which communicates with the drain opening O and is secured with the basin by a suitable flange, nut and gasket means. The means by which the fitting F is secured to the basin in no way affects the present invention and need not and will not be further considered. The lower end portion of the tube part of the fitting F slidably enters the upstream end portion of the trap. That is, it slidably enters the upwardly opening inlet end portion of an elongate flow passage defined by and extending through the drain trap.

In the case illustrated, the inlet end portion of the drain trap is externally threaded and carries a gland nut with a radially inwardly projecting flange that is spaced from the upstream end of the trap. A packing ring is engaged about the tube part of the fitting F, between the flange and the trap. Upon advancing of the nut relative to the trap, the packing is compressed and displaced into tight sealing engagement with the tube part, nut and trap, in accordance with old practices.

In the case illustrated, the drain pipe D is a straight horizontally disposed pipe spaced below the wash basin B and the lower end of the fitting F. The pipe is laterally offset from the central vertical axis of the drain opening and fitting F with its central axis perpendicular thereto. The inner inlet or upstream end of the pipe D, which is spaced from and disposed toward the vertical axis of the fitting F, opposes an outwardly opening, horizontal, downstream end of the flow passage in the trap T. The pipe D and trap T are shown releasably coupled together with an ordinary union fitting U.

In the preferred carrying out of the invention, the trap T comprises a unitary body 10 that is molded of a suitable polyester resin or plastic that has a low index of heat conductivity. Accordingly, the body 10 or the trap T can be said to be a thermally insulated or heat-insulated part or structure.

The body 10 includes an elongate vertically extending tubular inlet end portion or neck portion 11 with an open upper end. The neck portion 11 defines the upstream or inlet end portion X of the flow passage in the body.

In the form of the invention illustrated and as described above, the neck portion 11 and the tubular part of the fitting F are telescopically engaged.

The body next includes an elongate horizontal tubular outlet end portion or arm portion 12 with inner and outer ends and that defines a downstream or outlet end portion Y of the flow passage in the body.

As shown, the outer end of the arm portion 12 is externally threaded and is engaged in and with a part of the union fitting U. Another part of the union U is engaged about and is carried by the upstream end portion of the drain pipe D, in accordance with common practices.

The central longitudinal axis of the horizontally extending arm portion 12 of the body 10 is perpendicular to the central longitudinal vertical axis of the neck portion 11. The lower end portion of the neck portion 11 overlies, is integrally joined with and closes the inner end of the arm portion 12. The lower or bottom side of the arm portion 12 is on a horizontal plane that is spaced a predetermined distance above the horizontal plane on which the lower open end of the neck portion 11 lies. In practice, the vertical distance between the bottom side of the arm portion 12 and the lower end of the neck portion 11 can vary considerably but, as a general rule, need not be spaced apart more than one-half to three-quarters of an inch.

In practice, the diameter of the neck and arm portions can be the same or can be different in diameter. As a general rule, if the diameter of the neck and arm portions is not the same, the diameter of the arm portion is larger than the diameter of the neck portion to facilitate connecting the trap with a drain pipe which is larger in diameter than the diameter of the drain fitting with which the trap is related.

The lower inner end portion of the arm portion 12 is relieved and opens downwardly.

The body 10 next includes a central upwardly opening trap basin portion 14 that occurs between the neck and arm portions. The basin portion 14 defines a central portion Z of the flow passage that extends in and through the trap. The basin portion 14 underlies and communicates with the lower downwardly opening inner end portion of the arm portion 12 and with the lower end of the neck portion 11. The basin 14 has a horizontal bottom wall 15 and an outwardly and upwardly extending perimeter wall that joins with related wall portions of the neck and arm portions of the body. The perimeter wall has an upwardly and outwardly inclined end portion 16 that fairs into and joins with a related portion of the wall of the neck portion 11; an upwardly and outwardly inclined end portion 17 that fairs into and is integrally joined with related portions of the wall of the arm portion 12; and, outwardly and upwardly curved opposite side portions 18 that fair into and are integrally joined with related portions of the walls of the arm and neck portions, substantially as shown. In accordance with good practices, the adjacent portions of all angularly related walls of the body 10 are generously radiused so that the body is smooth and attractive in appearance and is free of undesirable sharp corners, angles and the like.

The upper central portion of the basin portion 14 has a central transversely extending, vertical inner wall 21 that divides the upper part of the upper portion of the basin to define vertically extending upstream and downstream end portions of the central portion Z of the flow passage and that depend into water that is deposited in and contained by the basin and by which gases tending to flow upstream through the trap cannot pass. Thus, the central portion Z of the passage defined by the basin 14 is substantially U-shaped, with a base portion below the wall 19; an upstream portion communicating with the portion X of the flow passage within the neck portion 11 of the body 10; and, a downstream portion communicating with the portion Y of the flow passage within the arm portion 11 of the body.

It is to be particularly noted that the U-shaped portion Z of the flow passage has a tightly radiused short inner side that is defined by the inner wall 21 and has a large radiused long outer side defined by the bottom wall 15 and the portions 16 and 17 of the perimeter wall of the basin portion 14. Further, when the basin portion 14 is filled with water, the volume of water that extends longitudinally of and occurs adjacent or in close proximity to the short inner side of the U-shaped portion Z of the passage is a little and small fraction of the volume of water that extends longitudinally of and occurs adjacent or in close proximity to the long outer side of that portion of the passage.

In the form of my invention now under consideration, the central inner wall 21 in the basin portion 14 is defined by a portion of a heat-conducting insert I.

Figure 2:
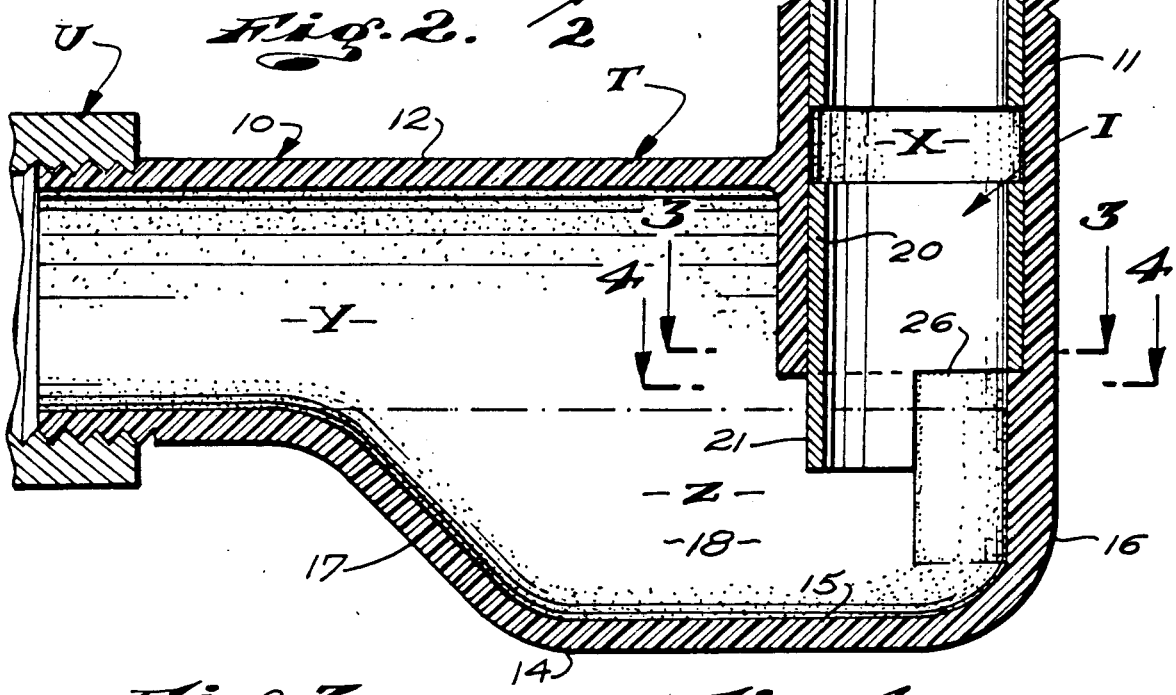
FIG. 2 is an enlarged cross-sectional view of the drain trap taken substantially as indicated by Line 2—2 on FIG. 1.

The insert I is made of a metal, such as copper or brass, that has a high index of heat conductivity. The insert has an upper heat-absorbing and storing portion 20 that is positioned in the lower portion of the neck portion 11 and within the upstream end portion X of the flow passage in the body. In the case illustrated, the upper portion 20 of the insert is a ring or tube-like portion that is slidably engaged in the neck portion 11 and has a lower edge that terminates above the previously noted plane of the bottom side of the arm portion 11, which is also the top plane of the basin portion 14 and the water level of water held within the basin portion 14. The top plane of the basin portion 14 and/or the water level within the body is indicated by a broken line in FIG. 2 of the drawings.

Figure 3:
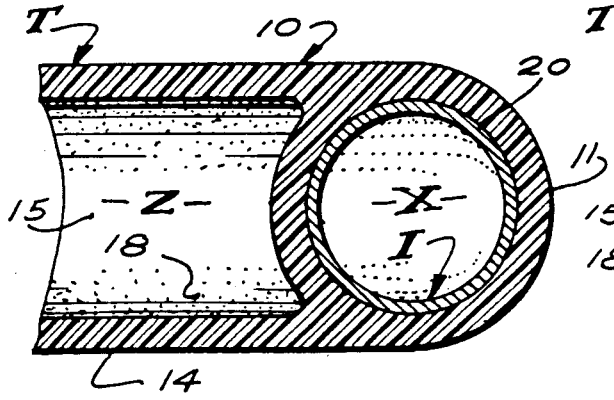
FIG. 3 is a sectional view taken as indicated by Line 3—3 on FIG. 2.
Figure 4:
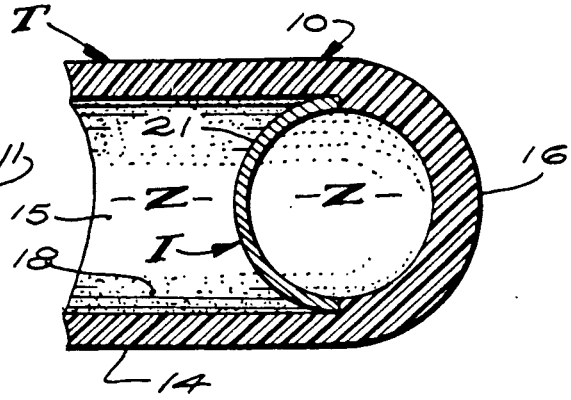
FIG. 4 is a sectional view taken as indicated by Line 4—4 on FIG. 2.

The insert I next has a heat-distributing lower portion 21 that depends from the upper portion 20 and that defines the upper inner wall 19 of the basin portion 14, as noted above and as clearly shown in FIGS. 3 and 4 of the drawings.

In the form of the invention now under consideration, the lower portion of the insert defining the wall 21 defining the wall 21 is a semi-circular extension of the upper sleeve portion 20 that depends from an inner half of the upper portion into the upper central portion of the basin portion 14, as shown.

In the case illustrated, the interior of the end portion of the perimeter wall of the basin portion 14 and the lower end portion of the neck portion 11 are formed with a protuberance 25 that defines an upwardly disposed stop shoulder 26 that opposes and against which the lower edge of the upper portion 20 of the insert I stops and seats. The protuberance also has vertically extending stop shoulders 27 that oppose and against which the vertical side edges of the lower portion 21 of the insert are seated, as clearly illustrated.

In practice, the exterior of the upper portion 20 of the insert I can be made to establish snug sealing engagement within the neck portion 11 of the body, and the shoulders 26 within the body can be made to establish sealing seating engagement with their opposing edges of the insert I. Alternatively, the fit between the insert and its related parts and/or portions of the body 10 can be made to accommodate a small amount of a suitable sealing compound therebetween whereby adequate sealing between the parts of the structure can be assured without maintaining tight and close tolerances between the parts of the structure.

Further, if desired or if circumstances require, the upper tubular sleeve-like portion 20 of the insert I can be split or otherwise formed to allow for free expansion and contraction of that portion of the insert if it is found that the differential in the coefficient of expansion and contraction of the materials of which the body 10 and insert I are made is likely to cause adverse effects.

The mass and surface area of the upper portion 20 of the insert I can be and is preferably made substantially greater than the mass and surface area of the lower portion thereof that establishes the wall 21 in the portion 14 so that the upper portion 20 can effectively and efficiently absorb and store a substantial amount of heat for subsequent protracted conducting of heat into and through the lower portion or wall 21 thereof. In the case illustrated, the mass and surface area of the upper portion 20 of the insert is approximately four times greater than the mass and surface area of the lower portion 21 thereof.

In use, when the trap T is left to stand with a volume of water filling the trap portion 14 thereof and that water freezes to establish an ice plug that stops up the flow of water through the trap and puts the trap and its related wash basin B out of service; the neck portion 11 and/or upstream end portion X of the flow passage in the trap is filled with hot water. The upper portion 20 of the insert I absorbs heat from that water. The heat absorbed and stored by the upper portion 20 of the insert is conducted directly into and through the inner wall 21, defined by the lower portion of the insert. The heat delivered by the upper portion 20 into the wall 21 is conducted directly into that small portion or volume of the ice plug that occurs adjacent and/or in close proximity to the wall and melts that ice to establish a small, short, flow passage in the ice through which the hot or warm water in the neck portion 11 commences to flow from within the neck portion, through the basin portion and thence into and through the arm portion of the trap. The flow of water is kept from freezing within the ice plug by heat delivered to it by the wall 21 of the insert and works to melt the ice through which it flows at a rapid rate so that the trap T and its related wash basin B are again made fully serviceable.

It is important to note that the insert I is made to work upon and to melt that small portion of an ice plug that forms about the short inner side of the U-shaped central portion Z of the flow passage in the body of the trap and that the amount of heat and time required to melt and establish an effective passage for water in and through the ice plug is minimal.

It has been determined that when my new trap structure is plugged by an ice plug, as noted above, and about four cups of water heated to about 170° F. is poured into the neck portion 11 of the trap, a flow passage in and through the ice plug, through which water commences to flow, is established in about one minute. When a greater volume of heated water is used, that time is reduced.

It has also been determined that once a flow of water is established through an ice plug in the trap formed therein, and a supply of hot, warm or tepid water is maintained upstream of the ice plug to flow through the plug, the plug melts at a surprisingly rapid rate and the trap T becomes sufficiently open for regular or full service during that period of time that is usually expended when first putting the sink B with which the trap is related, to use. For example, when the trap T is stopped up by an ice plug and its related sink B is partially filled with hot water, the ice plug is reduced and the hot water commences to drain from the basin before the water in the basin has been put to its intended use. Accordingly, regular stoppings or plugging of the drain opening O in the basin B is soon required so as not to lose and waste the water therein.

Figure 5:
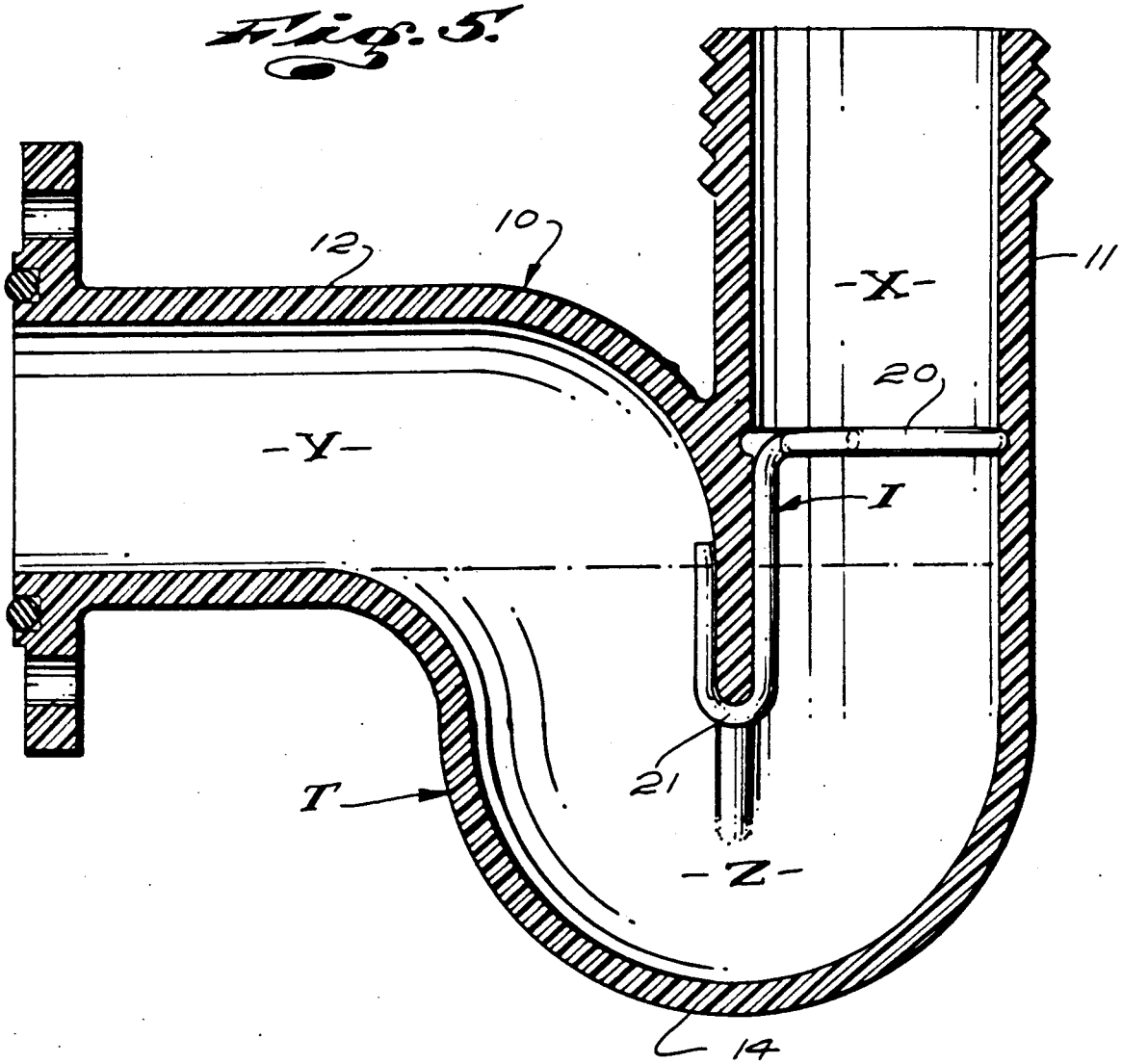
FIG. 5 is a cross-sectional view of another form of drain trap embodying my invention; and, FIG. 6 is an isometric view of the insert in the second form of my invention.
Figure 6:
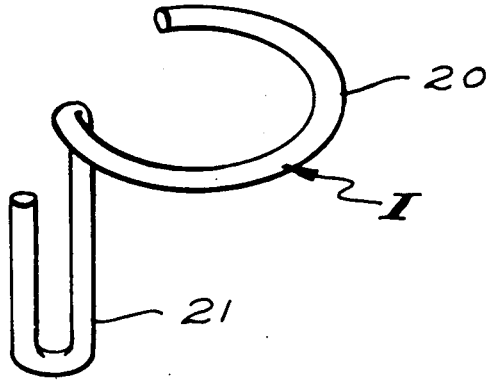

In FIGS. 5 and 6 of the drawings, I have shown another form of drain trap embodying my invention and wherein like reference characters and numbers are directed to corresponding parts and portion of the drain trap.

In the second form of drain trap T, the body 10 and insert I are made of the same or similar materials of which those parts of the first form of my invention are made.

The neck portion 11 of the body 10 is similar to the neck portion of the body in the first form of the invention.

The arm portion 12 of the body 10 is provided with a mounting flange 30 and a sealing ring 31 instead of being externally threaded and connected with a union fitting, as shown in the first form of the invention.

The basin portion 14 is less "boxy" or more radiused than the basin portion in the first form of the invention; and, the central inner wall 21 of the basin portion is an integral part of the plastic body 10. The several portions 11, 12, 14 and 21 of the body 10 are arranged relative to each other in the same way that those portions in the first form of the invention are arranged related to each other.

The insert I in this second embodiment of my invention is a unitary part formed of heavy wire or light rod stock, the gauge and cross-section of which can be varied to provide the insert with the necessary mass and surface area to enable it to perform its intended function.

The insert I has a semi-circular or annual, horizontal, upper portion 20 that is yieldingly engaged and seated in a radially inwardly opening annual groove 40 formed in the neck portion 11 that defines the inlet end of portion X of the passage way in the body and has a depending upwardly opening U-shaped recurvant lower portion 21' that extends downwardly onto the central portions of the passageway, under and thence upwardly about the wall, 21' to terminate in the outlet end portion Y of the passageway, as clearly illustrated in the drawings.

This second form of my invention functions like and attains the same useful ends as does the first described form of the invention.

A notable advantage afforded by this invention that is not readily attainable when seeking to melt an ice plug in the U-shaped basin portion of an ordinary trap by applying heat to the exterior of the trap, resides in the fact that in both embodiments of the invention the inserts I conduct heat directly to the short inner sides of the U-shaped portions of the flow passages in which an ice plugs form, where the least amount of heat is required to melt and establish a flow passage through the ice plugs. The short inner side of the flow passage in most ordinary drain traps is difficult to reach and is extremely difficult to apply exterior heat to. Also, since the body of my new trap need not be heated and the lower portions of the inserts is within the body and are thermally insulated from ambient atmosphere by the body, a very small amount of heat is required to effect reduction of the ice plug compared with that amount of heat required to heat a large portion of the body of an ordinary drain pipe to effect reduction of an ice plug therein.

Having described only typical preferred forms and applications of my invention, I do not wish to be limited to the specific details herein set forth but wish to reserve to myself any modifications and/or variations that might appear to those skilled in the art and which fall with in the scope of the following claims.

Having described my invention, I claim:

1. A drain trap engagable with and between a downwardly opening drain fitting and the open end of a horizontally disposed drain pipe that is spaced below and laterally offset from the drain fitting, said drain trap includes a body of plastic material having a low index of heat conductivity and has an elongate vertically extending tubular neck portion with an upper end connected with the drain fitting, an elongate horizontal tubular arm portion with an outer end connected with the drain pipe; an upwardly opening substantially U-shaped intermediate basin portion between and joined with the neck and arm portions the neck, arm and trap portions define a flow passage having an elongate vertically extending upstream end portion, an elongate horizontally extending downstream end portion and an elongate substantially U-shaped central portion having a short recurvant inner side defined by a central vertical inner wall within the basin portion; an insert of metal having a high index of thermal conductivity and having an upper portion within inlet end portion of the flow passage in the neck portion and a lower portion depending from its upper portion into and through the central portion of the flow passage in the basin portion of the body at and coextensive with said short recurvant inside thereof, the mass and surface area of the upper portion of the insert is greater than the mass and surface area of the lower portion thereof.

2. The drain trap set forth in claim 1 wherein the central inner wall in the basin portion of the body and defining the recurrant inner side of the central portion of the flow passage is defined by the lower portion of the insert.

3. The drain trap set forth in claim 1 wherein the upper portion of the insert is a tubular sleeve slidably engaged in and carried by the neck portion of the body.

4. The drain trap set forth in claim 1 wherein the upper portion of the insert is a tubular sleeve slidably engaged in and carried by the neck portion of the body, the lower portion of the insert depends from a lower edge of the upper portion of the insert at one side thereof and into the trap portion where it defines said inner wall and the short recurrant inner side of the central portion of the flow passage.

5. The drain trap set forth in claim 1 wherein the basin portion of the body has a horizontal bottom wall and a perimeter wall about the bottom wall and extending upwardly and outwardly therefrom to a horizontal plane that defines the top of a basin portion and the water level therein and which join with related portions of walls of the body defining the neck and arm portions thereof.

6. The drain trap set forth in claim 1 wherein the basin portion of the body has a horizontal bottom wall and a perimeter wall about the bottom wall and extending upwardly and outwardly therefrom to a horizontal plane that defines the top of a basin portion and the water level therein and which join with related portions of walls of the body defining the neck and arm portions thereof, the inner wall of the central portion of the U-shaped flow passage within the trap portion is defined by the lower portion of the insert.

7. The drain trap set forth in claim 1 wherein the basin portion of the body has a horizontal bottom wall and a perimeter wall about the bottom wall and extending upwardly and outwardly therefrom to a horizontal plane that defines the top of a basin portion and the water level therein and which join with related portions of walls of the body defining the neck and arm portions thereof, the upper portion of the insert is a tubular sleeve engaged in and carried by the neck portion of the body.

8. The drain trap set forth in claim 1 wherein the basin portion of the body has a horizontal bottom wall and a perimeter wall about the bottom wall and extending upwardly and outwardly therefrom to a horizontal plane that defines the top of a basin portion and the water level therein and which join with related portions of walls of the body defining the neck and arm portions thereof, the lower portion of the insert depends from the upper portion of the insert, at one side thereof and into the basin portion of the body where it defines the inner wall of the trap portion and the short recurrent inner side of the central portion of the flow passage.

9. The drain trap set forth in claim 1 wherein the lower portion of the insert depending from the upper portion thereof is a U-shaped portion engaged with and extending downwardly, under and thence upwardly about the inner wall of the body, and through the recurrent short inner side of the central portion of the flow passage.

* * * * *